US007104014B2

(12) United States Patent
Skuse et al.

(10) Patent No.: US 7,104,014 B2
(45) Date of Patent: Sep. 12, 2006

(54) APPARATUS FOR ILLUMINATING AND/OR VENTING THE INTERIOR OF A BUILDING

(75) Inventors: Tony Skuse, The Granary, Church Lane, Winterbourne, Bristol BS36 1SE (GB); Lee Rumley, Bristol (GB); Dale Jeffries, Bristol (GB)

(73) Assignees: Tony Skuse, Bristol (GB); Kevin Peter Bray, Bristol (GB)

( * ) Notice: Subject to any disclaimer, the term of this patent is extended or adjusted under 35 U.S.C. 154(b) by 0 days.

(21) Appl. No.: 10/619,753

(22) Filed: Jul. 15, 2003

(65) Prior Publication Data

US 2004/0057231 A1 Mar. 25, 2004

(30) Foreign Application Priority Data

Jul. 20, 2002 (GB) ..... 0216918.3
Oct. 2, 2002 (GB) ..... 0222820.3

(51) Int. Cl.
*E04B 7/18* (2006.01)

(52) U.S. Cl. ..... 52/200; 52/199; 52/72; 52/22

(58) Field of Classification Search ..... 52/200, 52/199, 198, 72, 22, 66, 207, 220.8, 745.15, 52/745.16
See application file for complete search history.

(56) References Cited

U.S. PATENT DOCUMENTS 3,090,613 A * 5/1963 Bechtold ..... 49/325
4,663,905 A * 5/1987 Schulz ..... 52/202
4,750,302 A * 6/1988 Bechtold ..... 52/72
4,782,743 A 11/1988 Quinnell
4,833,838 A 5/1989 Van Dame
4,848,051 A * 7/1989 Weisner et al. ..... 52/200
5,435,780 A * 7/1995 Ayles ..... 454/199
5,549,513 A 8/1996 Thomas et al.
5,561,952 A * 10/1996 Damron ..... 52/198
5,613,333 A * 3/1997 Witzig, Jr. ..... 52/200
5,673,520 A * 10/1997 Yannucci, III ..... 52/58
5,791,985 A * 8/1998 Schiedegger et al. ..... 454/339
5,806,255 A * 9/1998 Verby et al. ..... 52/200
6,142,645 A 11/2000 Han
6,196,915 B1 * 3/2001 Schiedegger et al. ..... 454/339
6,302,787 B1 * 10/2001 Graft, Jr. ..... 454/366
6,604,329 B1 * 8/2003 Hoy et al. ..... 52/200
2003/0000158 A1 * 1/2003 Borges ..... 52/200

FOREIGN PATENT DOCUMENTS

DE 326324 9/1920

(Continued)

*Primary Examiner*—Robert Canfield
*Assistant Examiner*—Chi Q. Nguyen
(74) *Attorney, Agent, or Firm*—MacMillan, Sobanski & Todd, LLC.

(57) ABSTRACT

Apparatus for illuminating the interior of a building through a roof of the building, the apparatus comprising a light transmissive panel 13 and a light directing duct 12. The panel 13 has an upper surface which is substantially identical in shape to an upper surface of a roof covering and lies in the plane of the said covering. The light directing duct 12 directs light from the panel 13 into the interior of the building.

The invention also relates to apparatus for venting the interior of a building. The apparatus comprises a venting panel 32 having at least one venting channel 44, and having an upper surface which is substantially identical in shape to, and lies in the plane of an outer covering of the building. The interior of the building is vented through the panel 32.

9 Claims, 10 Drawing Sheets

FOREIGN PATENT DOCUMENTS

| | | |
|---|---|---|
| DE | 7317047 | 9/1973 |
| DE | 2261722 | 6/1974 |
| DE | 9101664 | 6/1991 |
| DE | 19717781 | 11/1998 |
| FR | 2521618 | 8/1983 |
| FR | 2637929 | * 10/1988 |
| GB | 1455008 | 11/1976 |
| GB | 2262295 | 6/1993 |
| GB | 2279675 | 1/1995 |
| GB | 2282830 | 4/1995 |
| GB | 2317947 | 4/1998 |
| JP | 1239271 | 9/1989 |
| JP | 8326219 | 12/1996 |

* cited by examiner

APPARATUS FOR ILLUMINATING AND/OR VENTING THE INTERIOR OF A BUILDING

This invention relates to apparatus for illuminating and/or venting the interior of a building and particularly, although not exclusively, relates to skylights and/or roof vents.

BACKGROUND TO THE INVENTION

When domestic or commercial roof spaces are used as living accommodation, storage or office space, it is preferable that they are at least partially lit by natural light. Sometimes this is achieved by fitting Velux (registered trade mark) or Dormer windows. Although modern Velux and Dormer windows are functional and attractive, planning permission for such structures on a roof is sometimes refused, or they are considered undesirable by the owner of the building. In such circumstances, it is known to provide a skylight comprising a light reflective tube which passes through the roof and projects above the level of the roof. The tube is capped by a light transmissive cover which projects still further above the surface of the roof. The whole assembly is unnecessarily cumbersome and unsightly.

STATEMENTS OF INVENTION

According to a first aspect of the present invention there is provided apparatus for illuminating the interior of a building through a roof of the building, the apparatus comprising a light transmissive panel which has an upper surface which is substantially identical in shape to an upper surface of a roof covering and which lies in the plane of the said covering, and a light directing duct which directs light from the panel into the interior of the building.

Preferably, the light directing duct is fitted to an underside of the panel. Most preferably the light directing duct is sealed to an underside of the panel. For example it may be attached permanently with adhesive or a sealant and/or may be sealed with a resilient gasket.

Preferably, the upper surface of the panel is flush with an upper surface of the covering.

Preferably, the covering comprises roof tiles, shingles, slates or roofing sheets and the panel matches the contour and spacing of one or more roof tiles, shingles, slates or roofing sheets.

Preferably, the panel comprises a first light transmissive portion which is aligned with the light directing duct and an opaque portion. Preferably, the opaque portion is coloured and/or textured to match the roof covering.

Preferably, the duct passes through an underlay layer of the roof. The underlay layer may be sealed to an outer surface of the duct. For example, it may be sealed with a resilient gasket.

Preferably, the panel further comprises an air vent for allowing air from outside the roof to circulate through the duct. Preferably, an upper section of the duct includes apertures which allow the air to pass into and out of the duct.

Preferably, a lower end of the duct is provided with a light transmissive cover. Preferably, at least part of the panel and/or the cover are transparent or translucent. Preferably, the panel and/or the cover are made from a plastics material such as polycarbonate.

It is well known that the temperature difference between the outside of a roof and the roof space beneath the roof can cause a build up of condensation within the roof space. This problem can be alleviated by venting the roof, so that fresh outside air flows across the roof space, thereby reducing the temperature within the roof space and reducing the humidity. It is known to vent roofs through vents provided under the eaves or above the weather boarding. This can provide some limited through flow of air, but the venting is greatly improved if vents are also provided along the ridge line of the roof. Conventional ridge vents project above the level of the roof and are unsightly.

According to a second aspect of the present invention, there is provided apparatus for venting the interior of a building, the apparatus comprising a venting panel having at least one venting channel, and having an upper surface which is substantially identical in shape to, and lies in the plane of, an outer covering of the building, the interior of the building being vented through the panel.

Preferably, the outer covering is a roof covering of the building such as tiles, shingles, slates or roofing sheets.

The venting channel may comprise a flow passage formed in or attached to the venting panel.

Preferably, the venting channel comprises an inlet at an edge of the panel and a plurality of air directing fins associated with the inlet. Preferably, a portion of at least one of the fins is offset relative to the inlet or is curved, to prevent rainwater entering the inlet. At least one of the fins may have a corrugated profile, and may extend in a direction substantially perpendicular to the inlet.

Preferably, a duct is provided which is in fluid communication with the channel formed in the roof tile, the duct passing into the interior of the building.

Preferably a fan is provided which is adapted to assist the flow of air through the panel and/or the duct.

Various objects and advantages of this invention will become apparent to those skilled in the art from the following detailed description of the preferred embodiments, when read in light of the accompanying drawings.

DETAILED DESCRIPTION OF PREFERRED EMBODIMENTS

Figure 1:
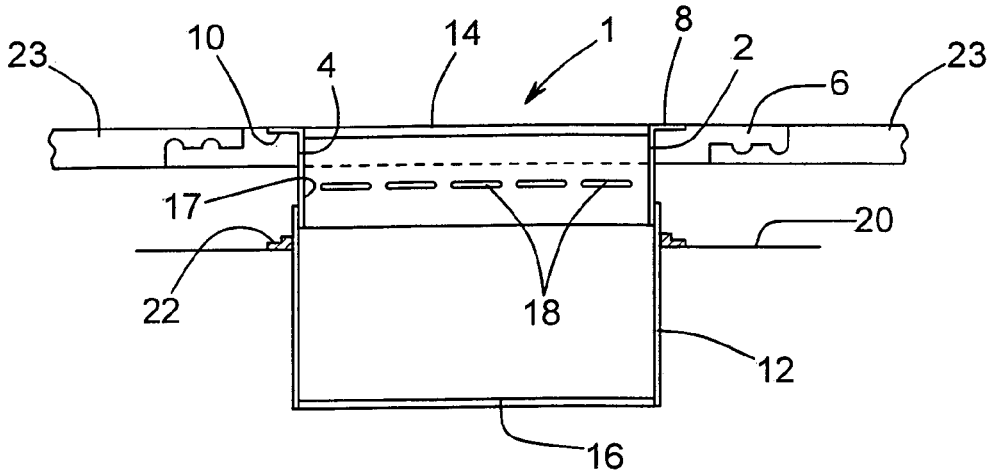
FIG. 1 is a cross section through a first embodiment of skylight.
Figure 2:
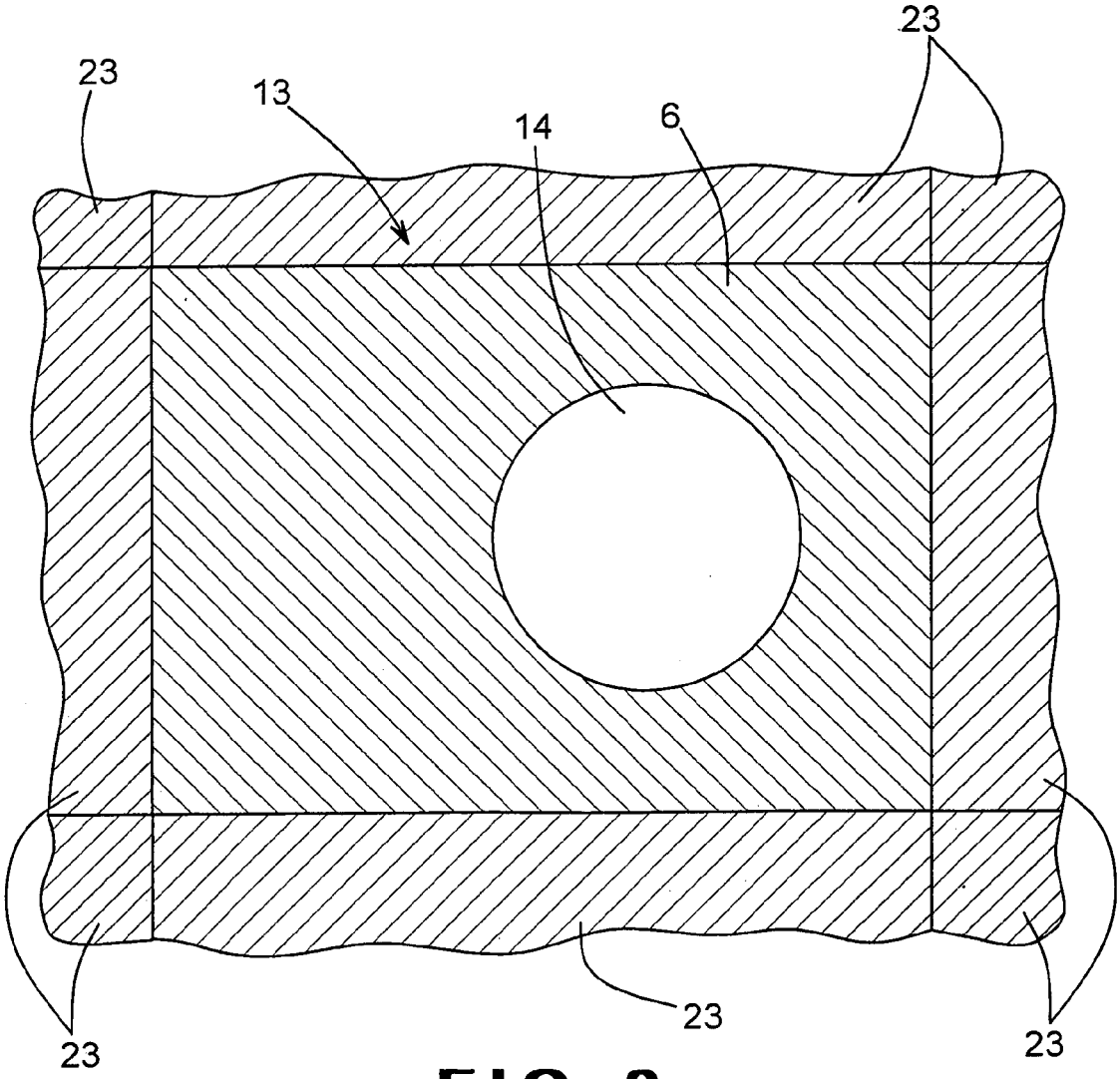
FIG. 2 is a top view of the skylight of FIG. 1.

FIGS. 1 and 2 show a first embodiment of skylight 1 comprising a cylindrical housing 2 fitted into a cylindrical opening 4 formed in a tile 6. The cylindrical housing 2 is provided with an annular flange 8 which sits in a recess 10 formed in an upper surface of the tile 6 and prevents the cylindrical housing 2 slipping through the tile 6 in service. The cylindrical housing 2 and annular flange 8 are sealed to the tile 6 by means of adhesive, sealant or a sealing gasket arrangement (not shown) so that the joint between the cylindrical housing 2 and tile 6 is weatherproof.

The cylindrical housing 2 projects from the bottom of the tile 6 and is connected to a cylindrical light directing duct 12. In the illustrated embodiment, and the cylindrical housing 2 is closely received within an end of the light directing duct 12. The joint between the cylindrical housing 2 and light directing duct 12 is sealed by flexible sealant. However, the cylindrical housing 2 and light directing duct 12 may be of any desired shape and may be interconnected in any conventional manner. For example, the external diameter of the light directing duct 12 may be smaller than the internal diameter of the cylindrical housing 2 so that the light directing duct 12 is received within the cylindrical housing 2. Such an arrangement would be inherently more weatherproof, since rainwater could not easily penetrate the gap between the cylindrical housing 2 and light directing duct 12.

The upper end of the cylindrical housing 2 is sealed off by a light transmissive element 14 which forms, with the tile 6, a light transmissive panel 13. The opposite end of the light directing duct 12 is closed off by a light transmissive cover 16. Furthermore, the inside surface 17 of the light directing duct 12 and/or the cylindrical housing 2 is coated with light reflecting material, such is used in a conventional lamp reflector.

The light transmissive element 14 and light transmissive cover 16 may be formed from any transparent or translucent material, such as Perspex or polycarbonate. Furthermore, the tile 6 may be replaced with an artificial tile so that the cylindrical housing 2 and tile 6 may be moulded together as an integral unit. Indeed, if the artificial tile 6 is made of light transmissive material, such as Perspex or polycarbonate, the cylindrical housing 2, tile 6 and light transmissive element 14 can be integrally moulded together to form the light transmissive panel 13. The portion of the artificial tile 6 which does not need to be light transmissive can be opaqued by means of painting or the addition of a surface finish, so that it matches the surrounding roof tiles.

In an alternative embodiment (not shown) the cylindrical housing 2, light directing duct 12, light transmissive element 14 and light transmissive cover 16 could be formed together as a sealed evacuated or gas filed unit. In such a sealed arrangement, condensation within the unit would not be a problem. However, in the embodiment of FIGS. 1 and 2, in which the cylindrical housing 2 is separate from the light directing duct 12, it is preferable to include vent holes 18 which are open to the ambient air circulating beneath the tile 6. The vent holes allow the ambient air to circulate through the space between the light transmissive element 14 and light transmissive cover 16 and prevent a build up of condensation within the unit.

The skylight 1 is attached to a roof by removing a section of roof tiles 23 to gain access to an underlay layer 20. A hole is formed through the underlay layer 20 through which is fitted the light directing duct 12. The duct 12 is sealed to the underlay layer 20 by means of a gasket 22. The tile 6 is then lowered into position, such that the cylindrical housing 2 fits within the light directing duct 12, and the gap between the two is sealed with a flexible sealant. Finally, the surrounding tiles 23 of the roof are made good.

As the skylight is located within a tile or artificial tile, when installed, and does not project above the upper surface of the tile the surface profile of the roof is maintained and all that is visible from the outside of the roof is the light transmissive element 14.

Figure 3:
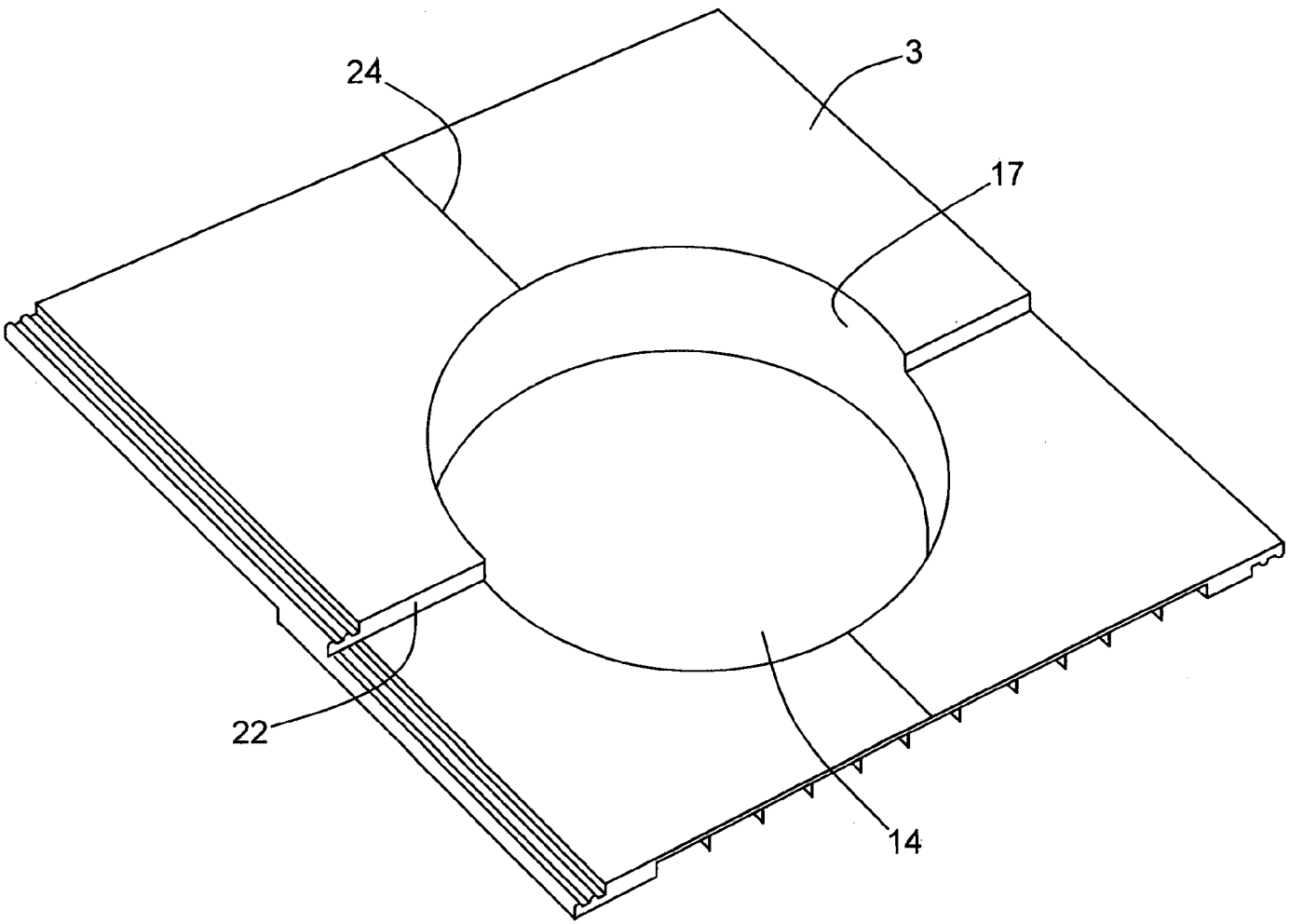
FIG. 3 is a perspective view of a large skylight.

FIG. 3 shows an alternative arrangement in which a single large light transmissive element 14 is fitted within a light transmissive panel 13 which is shaped to simulate four separate roof tiles, although it is integrally moulded as a single element. This is achieved by moulding into the panel 13 a step 22 to simulate the joint between upper and lower tiles and a groove 24 to simulate the gap between tiles laid side by side.

Figure 4:
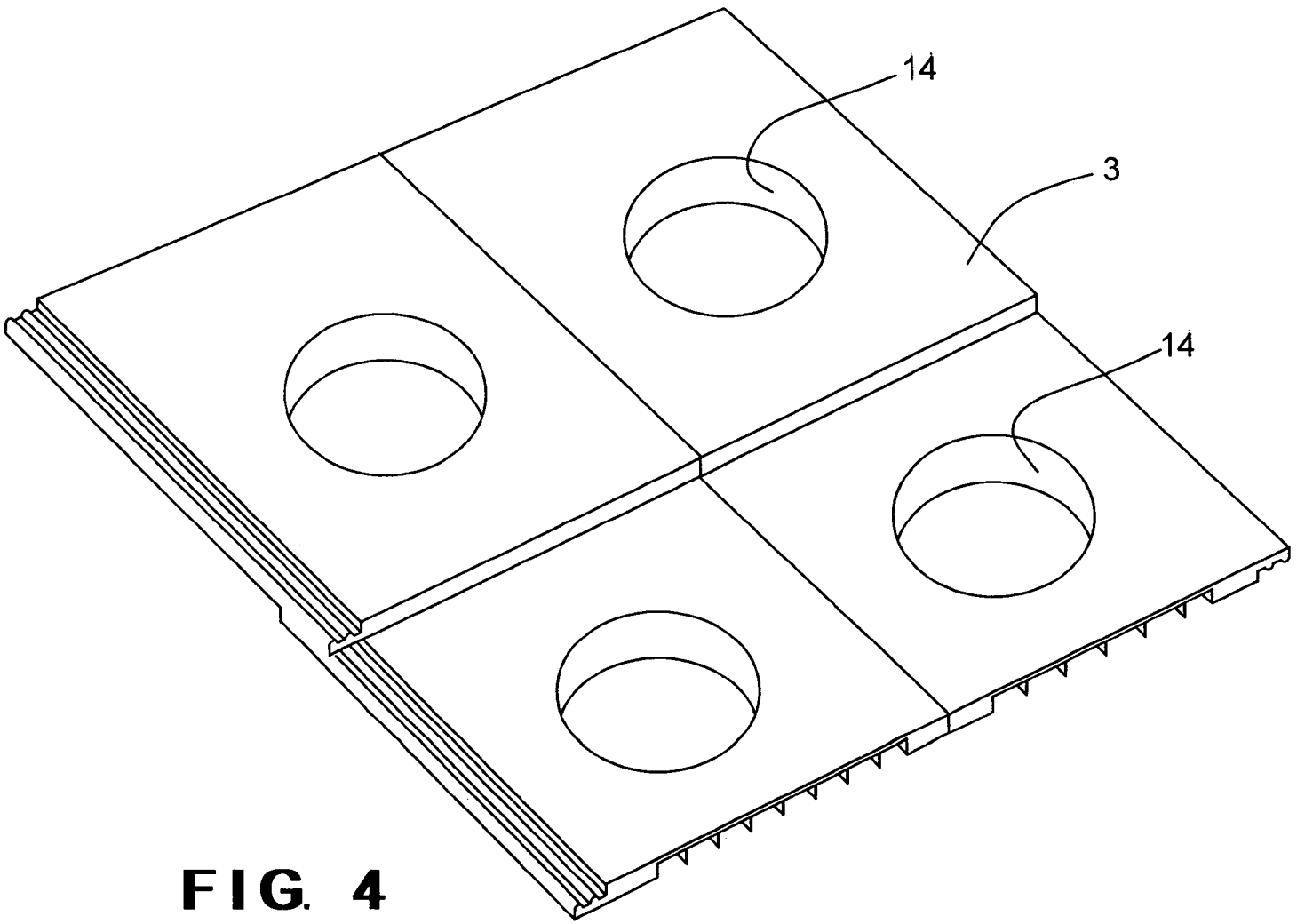
FIG. 4 is a perspective view of multiple skylights fitted to a single light transmissive panel.

FIG. 4 shows a further embodiment in which a single integrally formed light transmissive panel 13 is moulded to simulate four separate tiles and includes four individual light transmissive elements 14. The embodiments illustrated in FIGS. 3 and 4 increase the amount of light which is directed into a space beneath the roof for the minimal additional effort in fitting the skylight.

Figure 5:
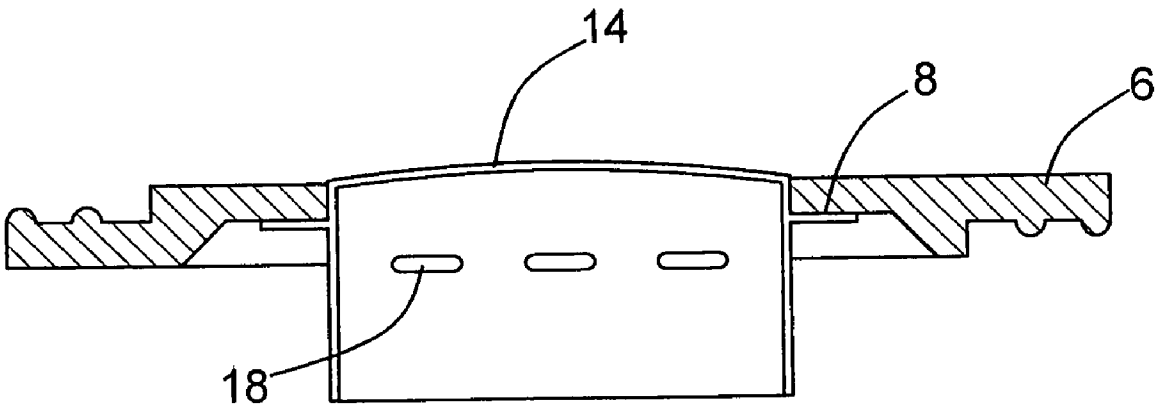
FIG. 5 is a cross section through a two part skylight assembly.

FIG. 5 shows an alternative embodiment of skylight in which the light transmissive element 14, the cylindrical housing 2 and the annular flange 8 are integrally formed together from light transmissive material and are inserted into a real or artificial tile 6 to form the light transmissive panel 13. As in the embodiment of FIGS. 1 and 2, vent holes 18 are formed in the cylindrical housing 2 and the base of the cylindrical housing 2 is adapted to receive a light directing duct 12.

Figure 6:
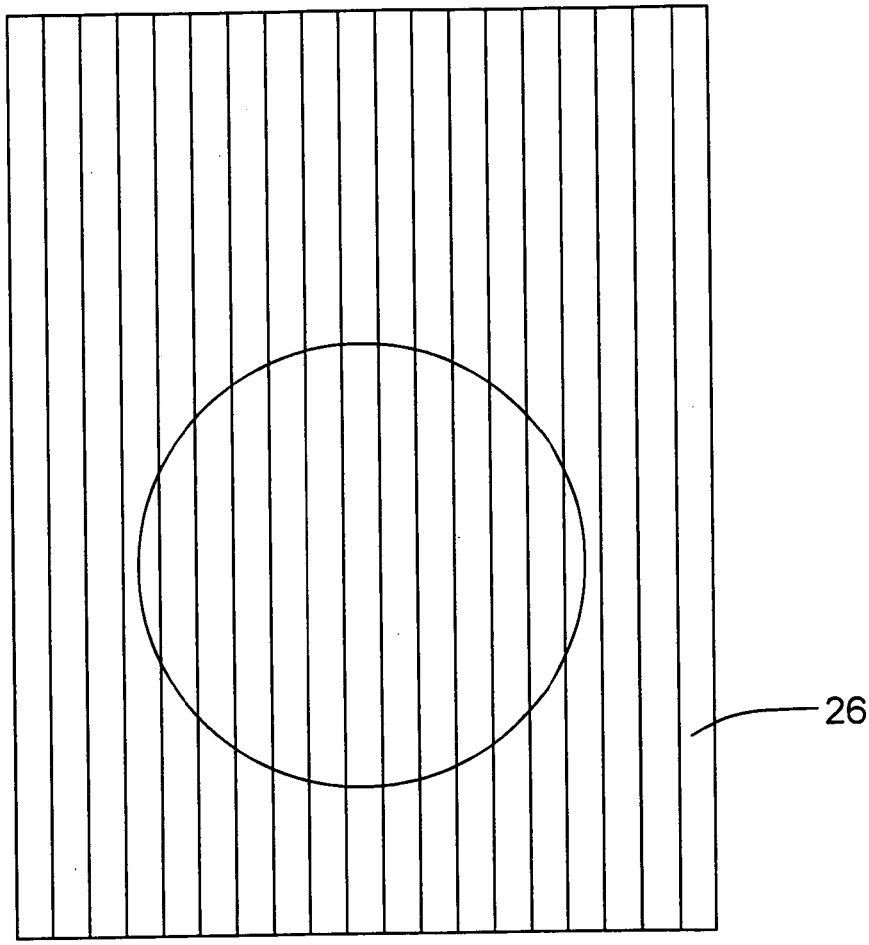
FIG. 6 is a plan view of a corrugated polycarbonate panel fitted with a light directing duct in accordance with the present invention.
Figure 7:
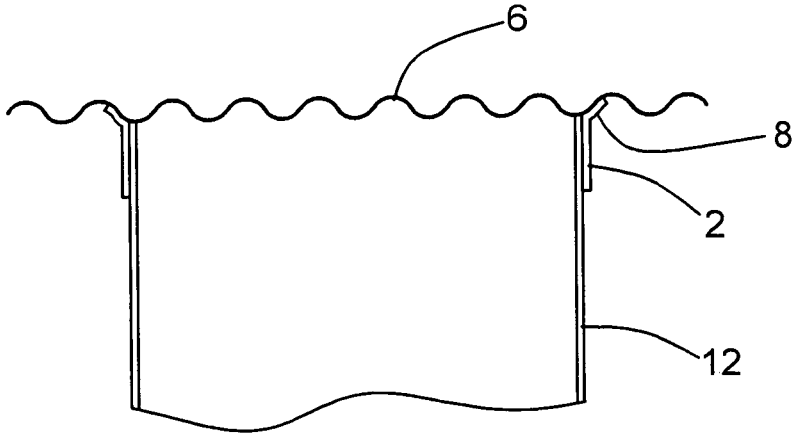
FIG. 7 is a cross section through the embodiment of FIG. 6.

FIGS. 6 and 7 show a further embodiment of skylight 1 in which the light transmissive panel 13 is formed by the roof covering itself. More specifically, the light transmissive panel 13 comprises a conventional corrugated polycarbonate roofing panel 26 to which the cylindrical housing 2 is fitted by means of adhesive or sealant applied to the flange 8. As in the previous embodiments, a separate light directing duct 12 is connected to the cylindrical housing 2, but in this embodiment it is received within the cylindrical housing 2.

In order to ensure an adequate seal between the roofing panel 26 and the cylindrical housing 2 the upper edge of the cylindrical housing 2 is shaped to accommodate the corrugations of the roofing panel 26.

FIGS. 8 to 12 show a roof vent 30 in accordance with a second aspect of the present invention. The roof vent comprises a panel 32 which may be opaque (FIG. 9) or wholly or partially light transmissive (FIG. 10), and has an upper surface which is substantially identical in shape to, and lies in the plane of an outer covering of a roof.

Figure 8:
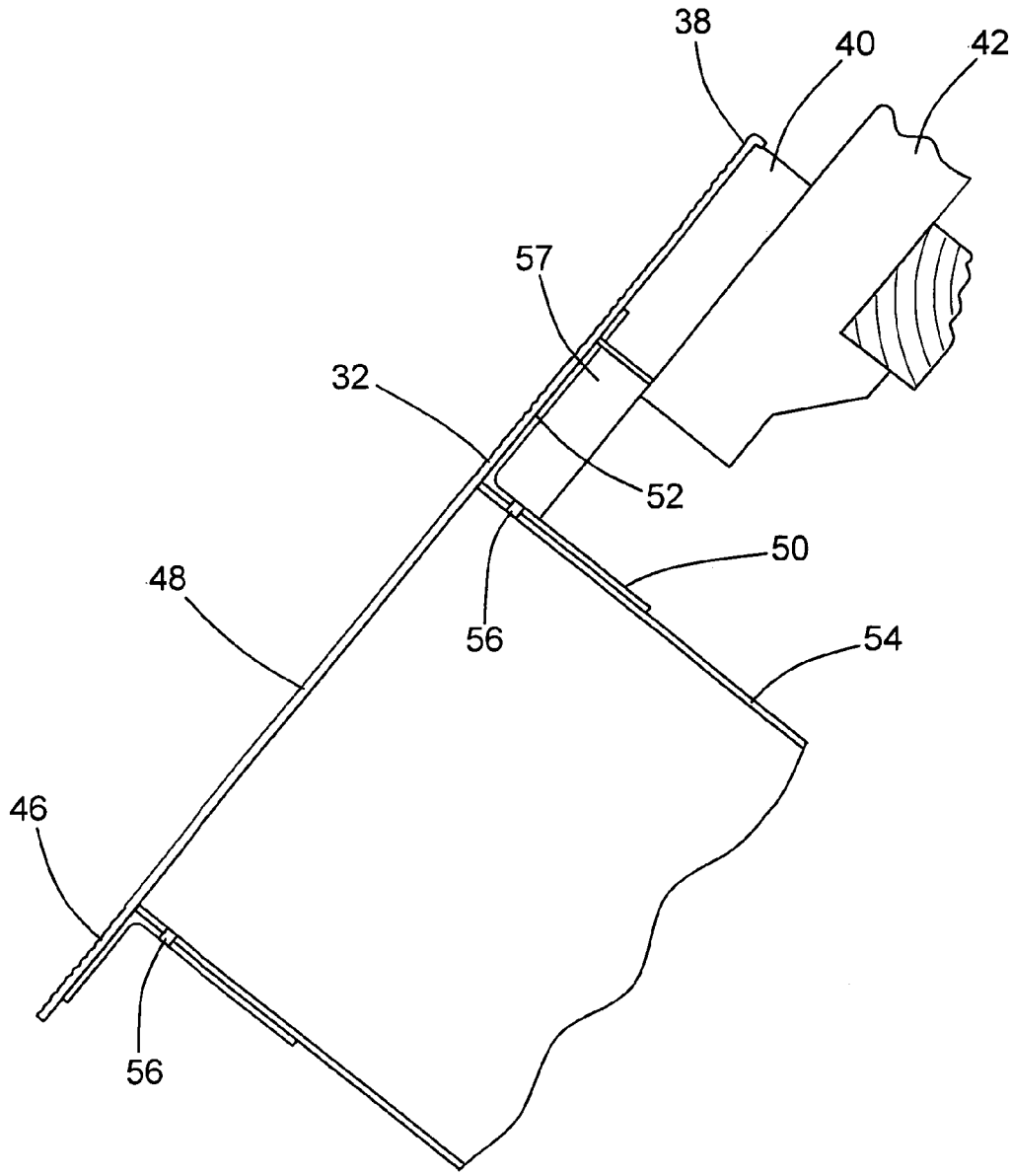
FIG. 8 is a cross section through a skylight integrally formed with an air vent.
Figure 9:
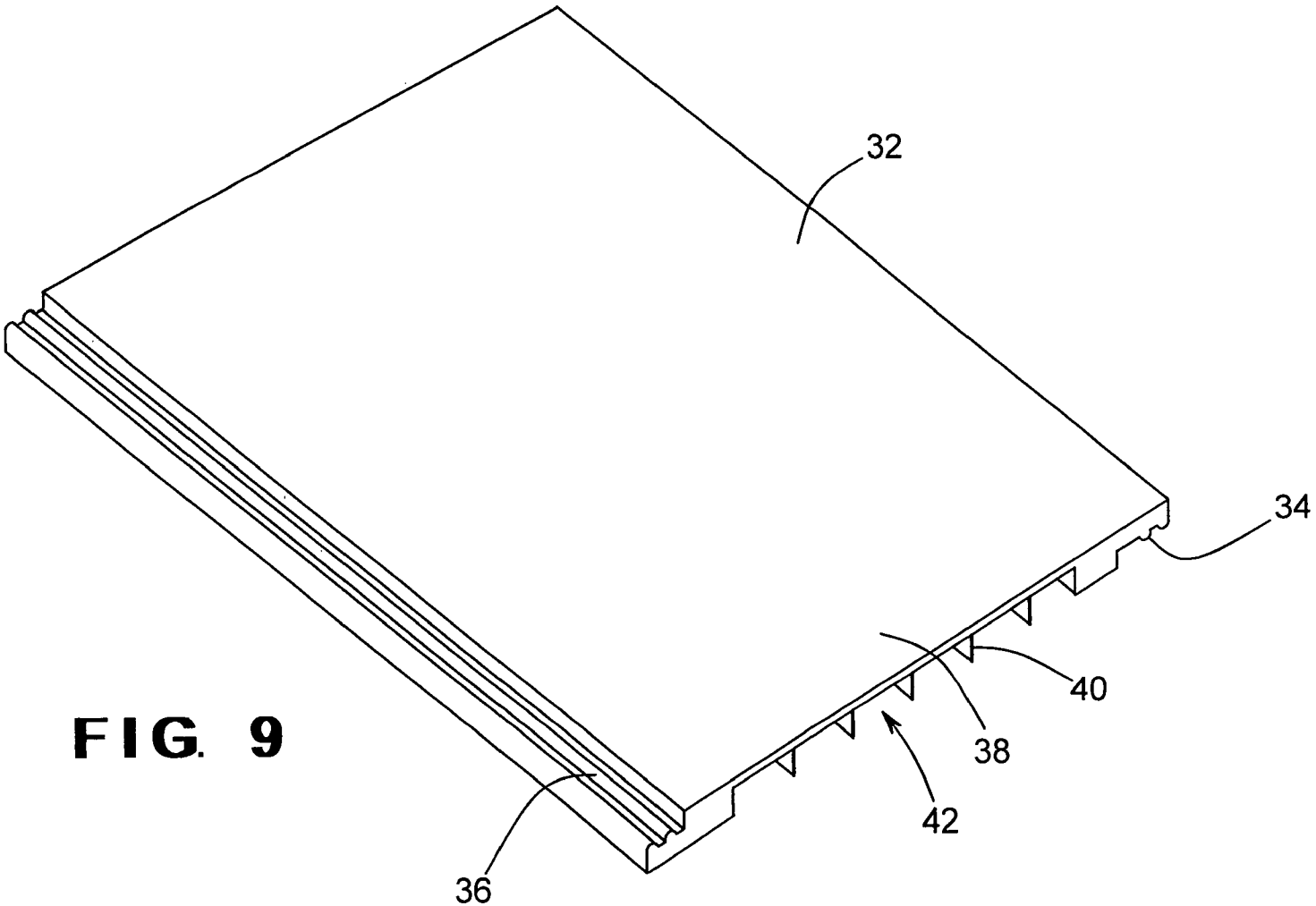
FIG. 9 is a perspective view of an artificial roof tile in accordance with the embodiment of FIG. 8.
Figure 10:
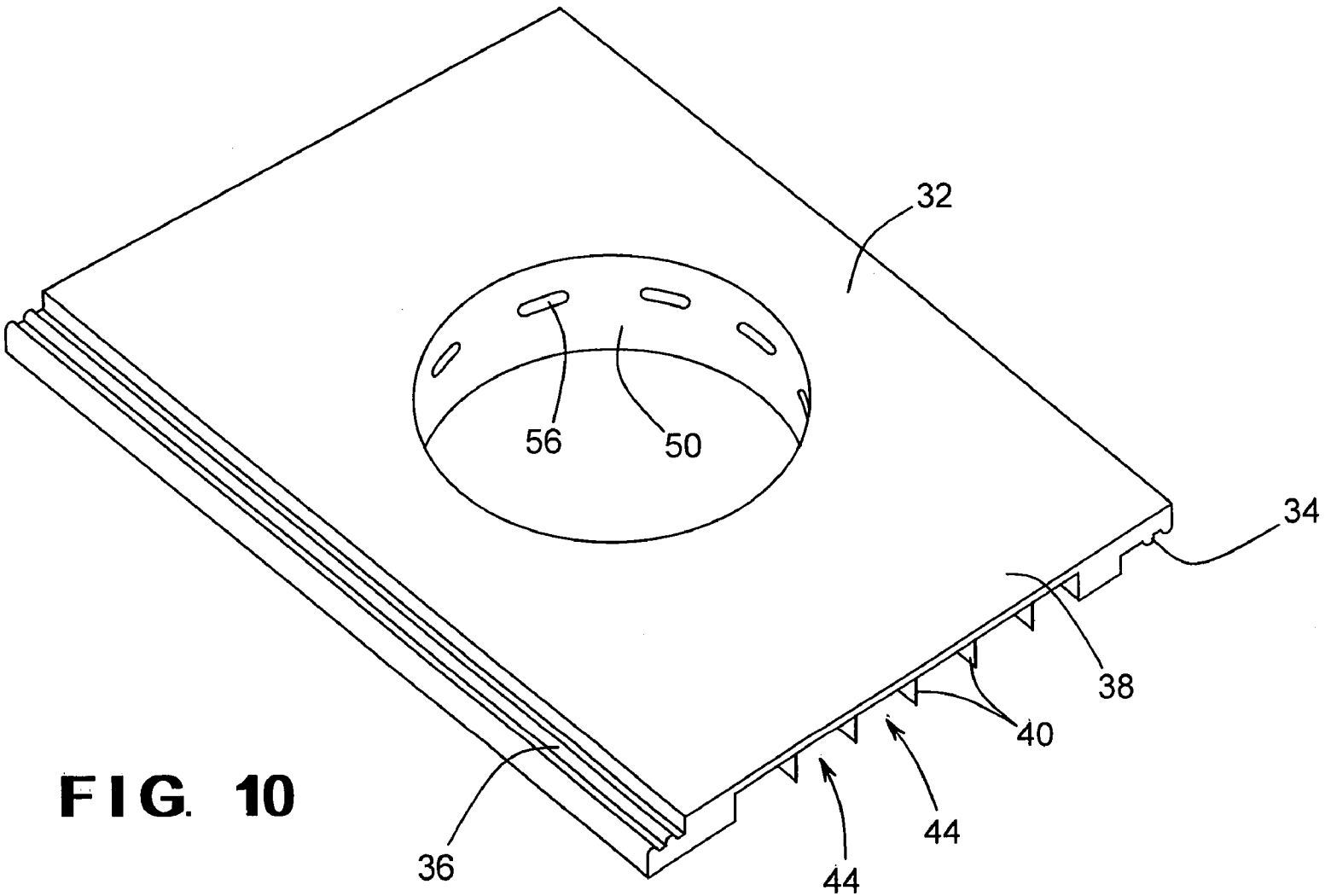
FIG. 10 is a perspective view of an artificial roof tile combining the functions of skylight and roof vent.

Referring specifically to FIGS. 8 and 10, the panel 32 is formed from plastics material and is moulded in the shape of a conventional roof tile on its upper surface and in the regions 34, 36 which are adapted to engage with other tiles on the roof. However, the underside of the panel 32 at its lower edge 38 is formed with a series of fins or baffles 40. The baffles 40 project at right angles from the underside of the panel 32 and extend downwards as far as an underlying tile 42, so that vent channels 44 are defined between respective pairs of baffles 40.

In the FIG. 8 embodiment, the panel 32 is formed entirely from polycarbonate. The upper surface of the panel 32 is coated in the regions 44, 46, so that these regions are opaque and substantially match the appearance of neighbouring tiles on the roof. The circular portion of the upper surface of the panel 32 between the opaque portions 44, 46 is left transparent and acts as a light transmitting element 48. Beneath the light transmitting element 48 is fitted a cylindrical housing 50 which is sealed to the panel 32 by means of an annular flange 52. A cylindrical light directing duct 54 is closely received within the cylindrical housing 50 and is held in position by adhesive or sealant.

Vent holes 56 are formed through the cylindrical housing 50 and light directing duct 54 and a vent passage 57 is formed in the panel 32 between the baffles 40 and the cylindrical housing 50. The interior of the light directing duct 54 is held in fluid communication with the vent channels 44 formed in the underside of the panel 32 via the vent holes 56 and the vent passage 57.

If the lower end of the light directing duct 54 is closed by a transparent or translucent cover, the vents merely operate to prevent condensation within the light directing duct 54. However, if the lower end of the light directing duct 54 is left open, or additional vent holes are provided at a lower end of the light directing duct 54, ambient air is able to pass from the vent channels 42 into the roof space, via the vent holes 56 and the light directing duct 54. Thus, vent panel 32 can be used either with a skylight assembly, or on its own as a means of venting a roof or loft space.

Figure 11A:
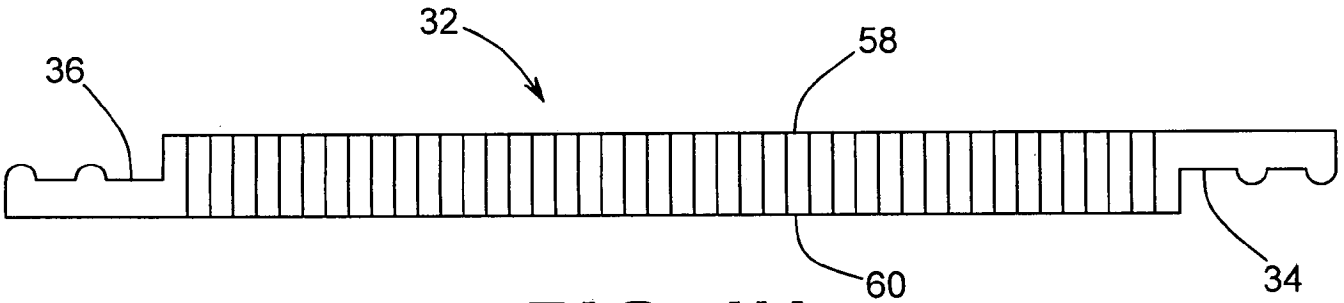
FIG. 11*a* is a view on the lower end of an artificial roof tile showing a vent opening.
Figure 11B:
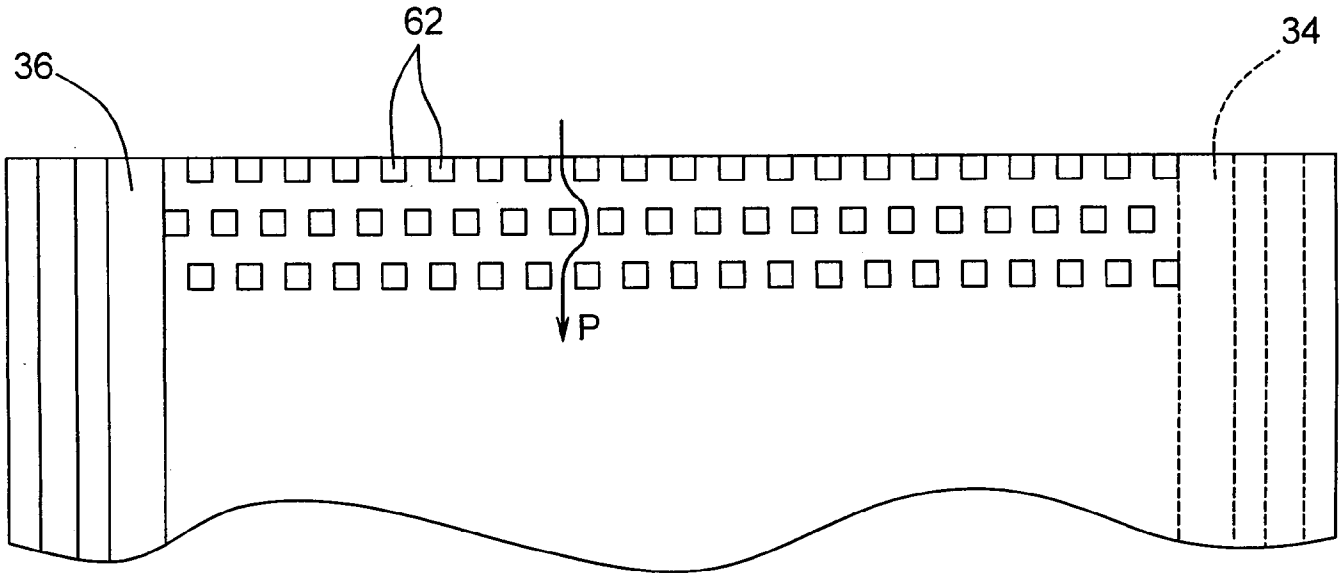
FIG. 11*b* is a cut-away plan view of the end of the roof tile illustrated in FIG. 11*a;*

FIG. 11 shows an alternative embodiment in which the lower end 38 of the panel 32 is formed as a hollow tube having an upper wall 58 and a lower wall 60, which are spaced apart by a plurality of staggered rows of posts 62. The upper wall 58, lower wall 60 and posts 62 define a tortuous flow path P for air entering the panel 32, so that rain is unable to find a direct path and is prevented from penetrating beyond the first few rows of posts 62 of the panel 32.

Figure 12A:
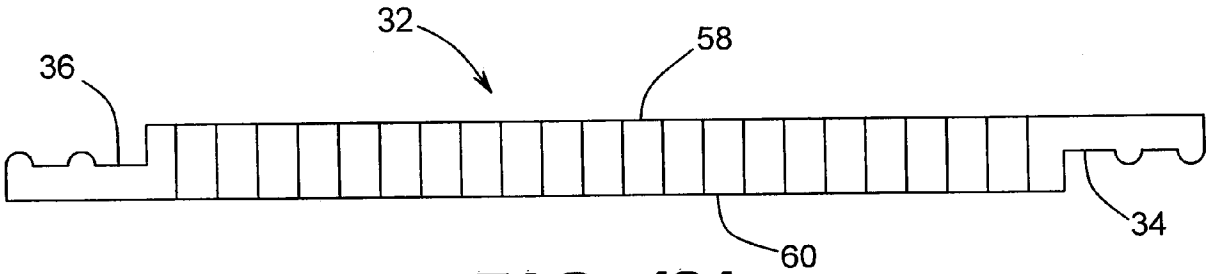
FIG. 12*a* is a view on the lower end of an artificial roof tile showing a vent opening.
Figure 12B:
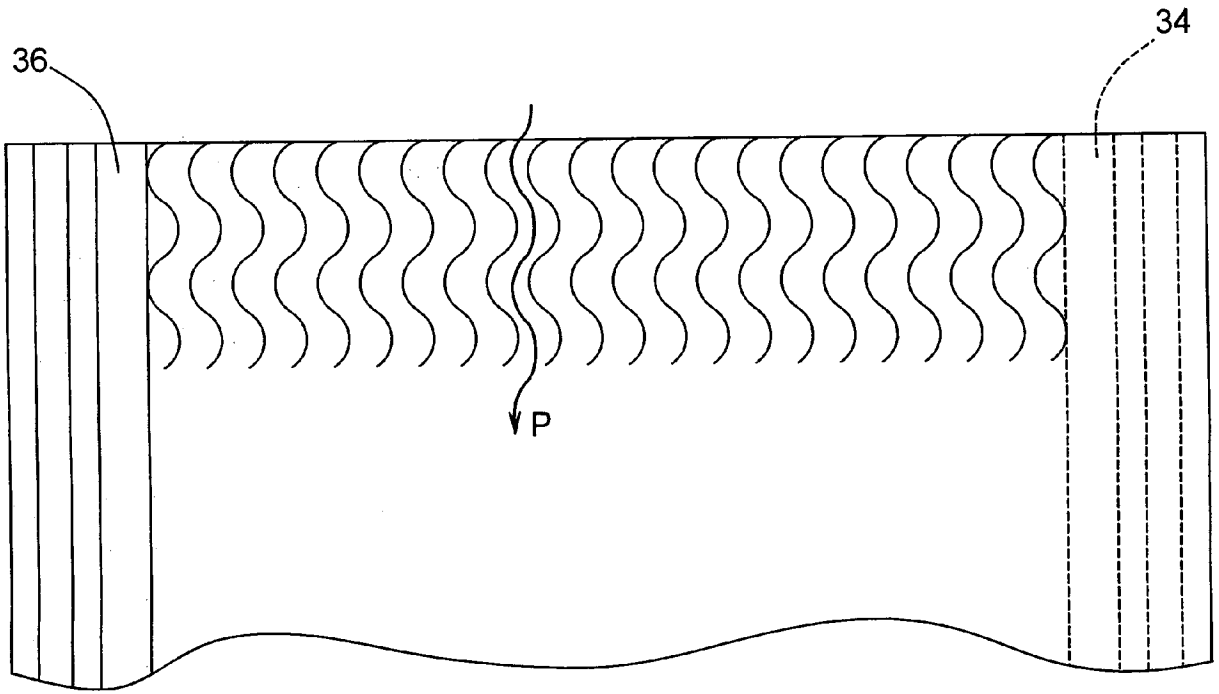
FIG. 12*b* is a cut-away plan view of the end of the artificial roof tile of FIG. 12*a*.

FIGS. 12*a* and 12*b* show a further embodiment in which the lower end 38 of the panel 32 is provided with an upper wall 58 and a lower wall 60 spaced apart by baffles 64 which are corrugated in cross section. These baffles 64 act in the same way as the posts 62, since they force air entering the panel 32 to follow a tortuous path P which prevents the ingress of rain.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

The invention claimed is:

1. An apparatus for illuminating an interior of a building including a roof having a hole formed therethrough, said apparatus comprising:

a roof tile adapted to be supported on a roof of a building, said roof tile including an upper surface having a shape and defining a plane;

a panel abutting said roof tile, said panel including an opaque tile having an opening formed therethrough and a light transmissive element that extends across said opening, said opaque tile having an upper surface that is substantially identical in shape to said shape of said upper surface of said roof tile and that is co-planar with said plane defined by said roof tile; and a light directing duct supported on said panel and adapted to extend through a hole formed through the roof of the building for directing light from said light transmissive element of said panel to an interior of a building.

2. The apparatus defined in claim 1 further including a light transmissive cover that is supported on said light directing duct.

3. The apparatus defined in claim 1 wherein said panel further includes a housing having a first end that is supported on said opaque tile and a second end that supports said light directing duct.

4. The apparatus defined in claim 3 wherein said first end of said housing has a flange that is received within a recess formed in said opaque tile.

5. The apparatus defined in claim 3 wherein said light transmissive element is supported on said first end of said housing.

6. The apparatus defined in claim 5 further including a light transmissive cover that is supported on said light directing duct.

7. The apparatus defined in claim 3 further including a plurality of vent holes formed through said housing.

8. The apparatus defined in claim 1 wherein said upper surface of said light transmissive element is flush with said plane defined by said roof tile.

9. The apparatus defined in claim 1 wherein said roof tile and said panel have respective connecting structures provided thereon that cooperate with one another to connect said roof tile to said panel.

* * * * *